United States Patent [19]

Obenauf et al.

[11] Patent Number: 4,502,035

[45] Date of Patent: Feb. 26, 1985

[54] GOLFER'S HEAD MOTION SENSOR

[76] Inventors: James E. Obenauf, 8457 E. Desert Steppes, Tucson, Ariz. 85710; Charles E. Brodish, 8805 SE. 78th. St., Mercer Island, Wash. 98040

[21] Appl. No.: 512,236

[22] Filed: Jul. 11, 1983

[51] Int. Cl.[3] ..... G08B 23/00; G08B 21/00; A63B 69/36

[52] U.S. Cl. ..... 340/323 B; 273/183 B; 273/190 A; 434/252; 340/665; 340/669; 340/384 E

[58] Field of Search ..... 340/323 R, 669, 665, 340/384 E; 364/410; 116/222; 434/252; 273/183 B, 190 R, 190 A, 186 C

[56] References Cited

U.S. PATENT DOCUMENTS

| | | | |
|---|---|---|---|
| 2,191,683 | 2/1940 | Roberts . | |
| 3,025,064 | 3/1962 | Flood | 273/183 |
| 3,363,023 | 1/1968 | McMahon | 434/252 |
| 3,676,802 | 7/1972 | Murphree | 340/384 E |
| 3,717,857 | 2/1973 | Evans | 340/323 R |
| 3,945,646 | 3/1976 | Hammond | 340/323 R |
| 4,098,509 | 7/1978 | Van Krevelen | 273/183 B |
| 4,268,035 | 5/1981 | Oppenheimer | 273/186 C |
| 4,326,718 | 4/1982 | Kiehl | 273/183 B |
| 4,346,363 | 8/1982 | Wilhelmson | 340/384 E |

*Primary Examiner*—James J. Groody
*Attorney, Agent, or Firm*—J. Michael McClanahan

[57] ABSTRACT

A device for sensing and indicating movement of a golf player's head adapted to be worn upon the golfer's cap proximate the side of the head, the motion sensor adapted to sense motion of the golfer's head up and down and side to side, the motion sensor device outputting an electrical signal in accordance with movement acceleration sensed to a signal processing unit which generates a variable audio frequency electrical signal in accordance with electrical signal received from the motion sensor, and an audio output device receiving the electrical signals from the signal processing unit, the audio output device being such as an earphone worn in or near the golfer's ear to indicate to the golfer in real time motion made by his head at and during the time that he makes his golf swing.

9 Claims, 6 Drawing Figures

GOLFER'S HEAD MOTION SENSOR

BACKGROUND OF THE INVENTION

It is well known that head motion, particularly rapid or jerking motion, adversely influences performance in a number of physical activity. Examples of these activities include striking a golfball, putting a golfball and hitting a pitched baseball. Success in these physical endeavors requires development of a technique or swing that minimize disruptive head motion. Acquiring the required skill is a difficult time-consuming task often requiring special coaching.

For example, one of the most difficult problems confronting a golfer during the backstroke and swing of the golf club prior to its impact with the ball is to keep his head down. In addressing the ball, the feet and head must be properly set relative to the ball. The head is the apex and the feet are at the base angles of a triangle and must be kept in such relative position throughout the swing. The cardinal principle of all golf shot making is that if you move year head, you ruin body action. It requires more than just keeping your eye on the ball because you can still be looking at the ball even though your head has moved more than enough to ruin your body action during the swing.

Modern technology has provided some aids to development of the required physical skills. Motion pictures and video recording systems are used to study physical sequences for an example. Such aids, while very useful, provide only after-the-fact information. To date, technology has not provided direct real-time information to the participant or coach which would allow effect feedback to the muscle/memory regarding physical sequences that reduce head motion.

To this end, it would be advantageous to provide means whereby a golfer or other athlete is provided with information indicative of head movement at the very time the golfer or other athlete is making his golf swing or other action being taken.

SUMMARY OF THE INVENTION

The subject invention defines a means by which a golfer or other athlete is provided direct real-time feedback on the occurrence and severity of his head motion as the golf swing or other effort is made. To this end, proportional audio feedback is used to transfer the information to the participant or to a nearby coach. The use of audio feedback allows effective transfer of information without involvement of any of the golfer's senses required to either perform or monitor performance of the physical act. The instantaneous feedback allows the participant to sense and collate muscle actions leading to success, thereby greatly aiding the learning process.

To accomplish the above, motion of the head must be sensed and this information transferred to the participant. To sense movement of the participant's head, a piezoceramic bender element fixedly held in a box container attached to the golfer's hat by a clip was utilized to sense vertical and horizontal motion in a vertical plane running through the golfer's body, head, shoulders, and arms. The acceleration movement of the golfer's head is sensed by the motion sensor which generates an electrical signal whose magnitude is relative to the magnitude of the acceleration of the participant's head. The electrical signal is conveyed by means of electrical wires to a signal processing unit which converts the electrical signal received to a second electrical signal which has either a frequency or an amplitude which is a function of the magnitude of the acceleration sensed, or a combination of amplitude and frequency as a function of the acceleration sensed. This signal in turn is directed to an audio output device which may consist of an earphone placed in or near the ear channel of the participant, or it could be an audio sound conveyed by other means to a nearby coach.

As a consequence, the participant is aware at the time that he makes his golf swing, stroke, or other athletic endeavor, of movement of his head or perhaps any other portion of the body whose movement he wished sensed. By sensing the movement of a portion of the body that is not desired to be moved, the golfer is in a position to correct the movement and thereby to improve his golfing or other athletic endeavor ability.

It is an object of the subject invention to provide a means by which indication of movement of a part of the body may be sensed and conveyed to the participant.

It is another object of the subject invention to provide means where indication of real-time movement of a portion of the party's body at the time it is moved is conveyed to the participant.

Other objects of the invention will in part be obvious and will in part appear hereinafter. The invention accordingly comprises the apparatus possessing the construction, combination of elements, and arrangement of parts which are exemplified in the following detailed disclosure and the scope of the application which will be indicated in the claims.

BRIEF DESCRIPTION OF THE DRAWINGS

For further understanding of the nature and object of the present invention, reference should be had to the following detailed description taken in connection with the accompanying drawings wherein.

In the various views, like index numbers refer to like elements.

DETAILED DESCRIPTION OF THE PREFERRED EMBODIMENT

Figure 1:
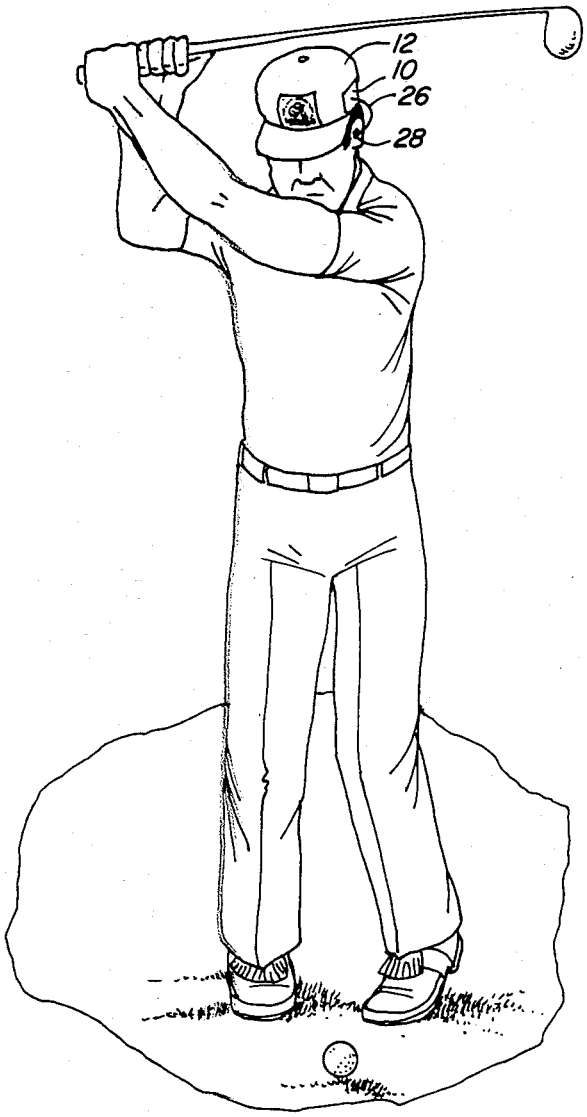
FIG. 1 is an illustration of a golfer utilizing the invention while preparing to take a swing.

The preferred embodiment of the device which senses movement of the golf player's head during the time that the golfball is being struck is shown in a suggested placement and use in FIG. 1.

Referring now to FIG. 1, an illustration of golf player 1 preparing to strike a golfball while wearing the subject invention about his head region is shown. The device is housed in a box-like container 10 which attaches by a clip or other means to the golf player's cap 12. Interiorly to box 10, to be described later, are the proportional motion sensor and the signal processing unit. Shown connecting with container 10 is electrical connector wire 26 which in turn is connected to the audio output device 28, here shown as an earphone held in the golf player's ear for directing audio sounds into the ear canal.

The type of motion sensor utilized in the preferred embodiment of the invention senses movement acceleration relative to itself, in two chosen directions in one plane. One direction is the vertical direction, i.e., movement of the motion sensor vertically up or down, and the other direction sensed in the plane is the horizontal. The plane formed by the sensed directions is the vertical plane formed passing through the golf player's shoulders, body and arms (for the arms the sides, or straight out from the sides). This plane chosen for sensing movement indicates motion of the golf player's head up or down, or side to side. Motion of the player's head, front to back, is not sensed except for the resultant motion up or down when the head pivots front to back at the neck.

As will be later explained, to sense the vertical and side to side horizontal motion, the motion sensor utilized in the preferred embodiment is located at a 45° angle relative to the vertical and the horizontal.

Figure 2:
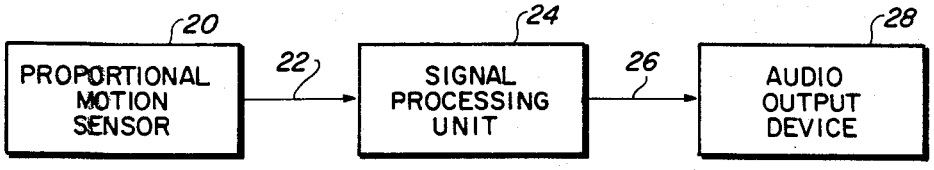
FIG. 2 is a block schematic diagram of the subject invention.

Referring now to FIG. 2, a schematic block diagram of the subject invention is shown. Proceeding in the direction of signal generation and processing, at the far left in FIG. 2 is block 20 representing the proportional motion sensor which, utilizing a commercially available piezoceramic bender element, generates an electrical signal when it senses movement acceleration relative to itself. This electrical signal, whose rise time and amplitude is related to acceleration sensed, is communicated by means of electrical connector wire 22 to the signal processing unit block 24 which in the preferred embodiment, is a commonly available voltage to frequency processor (also called voltage controlled oscillator). This processor generates an electrical signal which frequency is related to the acceleration sensed, i.e., the higher frequency reflecting a faster or higher head movement acceleration. The electrical signal from the signal processor block 24 is conveyed to the audio output device block 28 by means of the electrical connector wire 26. The audio output device block 28, as earlier mentioned, may be an earphone situated in or near the entrance to the ear channel of the golf player's ear.

In view of the foregoing, obviously the golf player is informed immediately of head movement he makes while he is in the process of taking his swing with the golf club. If he should move his head very fast, he will immediately receive an audio indication of a shrill, sharp noise in his ear. If he moves his head slowly as he swings, the immediate noise heard will be of a lower frequency. If possible, the golf player will correct his head in midstroke; if not possible, he can correct his head on the very next swing.

Figure 3:
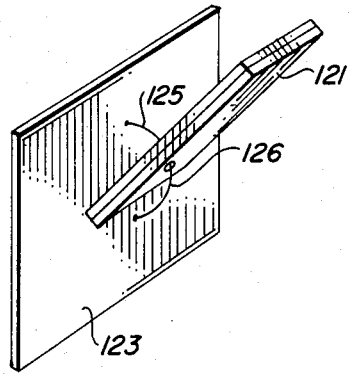
FIG. 3 is a perspective view of the construction orientation of the proportional motion sensor.

Returning to the illustrations, and referring now to FIG. 3, the construction orientation of the piezoceramic bender element 121 in a cantilivered position to plate 123 by attachment by an adhesive or other appropriate means is detailed. The piezoceramic bender element 121 is placed at a 45° angle with respect to the vertical and horizontal in plate 123. Attached to opposite sides of piezoceramic bender element 121 are electrical leads 125 and 126 from which electrical energy is drawn. This electrical voltage and current output is the electrical energy resultant of mechanical energy imparted to the piezoceramic bender element as it bends responding to movement acceleration. Attachment of the electrical leads and other product information may be obtained from the manufacturer of the motion sensor, namely Piezo Electric Products, Inc., of Metuchen, N.J.

The plate 123 is adapted to be situated interiorly to container 10 so that it will reside with its flat uninterrupted side opposite piezoceramic bender element proximate to the side of the golfer's head. In this manner, piezoceramic bender element 121 is protruding upward at a 45° angle and in the vertical plane bisecting the head, shoulders, and arms as earlier mentioned.

Figure 4:
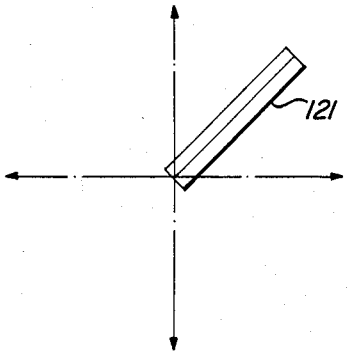
FIG. 4 is a drawing of the proportional motion sensor in relationship to the plane in which it resides.

Referring now to FIG. 4, an idealized two-dimensional drawing of the plane is shown with the piezoceramic bender element 121 bisecting the quadrant between the vertical and horizontal direction, representing the vertical plane bisecting the body, head, shoulders, and arms.

By the piezoceramic bender element 121's own weight, acceleration of the golf player's head by movement in the vertical or horizontal plane is transferred to the piezoceramic bender element 121 causing the element to bend. The mechanical action of bending generates an electrical signal which appears on leads 125 and 126 which is conveyed to the signal processing unit such as shown in FIG. 2. It is noted that the mechanical motion and hence the electrical output resulting from acceleration of the golfer's head may be increased by weighting the end of the cantilevered sensor.

All of the elements which have been described in the above four Figures which make up the preferred embodiment are well known in the art and commercially available. The proportional motion sensor of block 20 has been desscribed in detail showing its commercial availability and orientation in construction. The signal processing unit of block 24 is also commercially available, for example, a Burr-Brown voltage to frequency processor, model number VFC 32 may be utilized. Lastly, the audio output device consists in the preferred embodiment of a commercial pair of earphones, such as Calead part no. 15-107. All of these elements are interconnected as previously described and can be accomplished by any person familiar with the art. It is noted that other types of signal processing units may be utilized. A Burr-Brown 4203 multiplier could be used as a voltage to amplitude processor. A combination of a Burr-Brown VFC-52 and a Burr-Brown 4203 could implement a voltage to frequency and amplitude processor.

Figure 5:
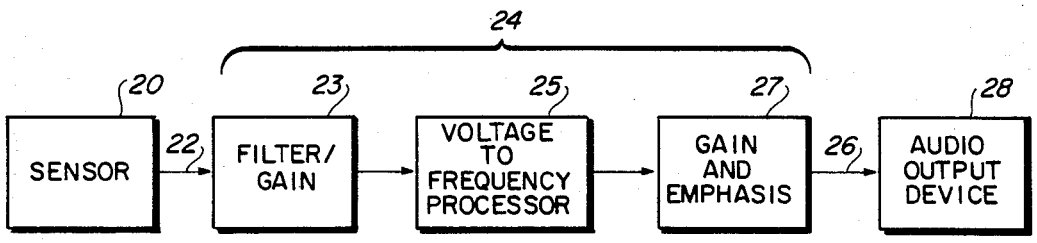
FIG. 5 is a schematic diagram of the preferred embodiment of the invention.

In FIG. 5 is shown in schematic block diagram form a more sophisticated embodiment of the invention as follows. More specifically, and from left to right, sensor 20 and audio output device 28 represent the same schematic blocks as previously shown. Signal processing unit of schematic block 24 now encompasses three more specific schematic blocks comprising the filter/gain block 23, the voltage to frequency processor 25, and the gain and emphasis block 27. The filter/gain schematic block 23 is a rejection filter of high frequency outputs from the proportional motion sensor 20. This is to reject sensor outputs that do not provide significant information concerning the golfer's head motion. After the signal has had its high frequencies filtered out, it is amplified before it is further processed. Receiving the filtered and amplified signal from filter/gain schematic block 23 is the voltage to frequency processor schematic block 25 which outputs an electrical signal whose variable frequency is related to the amplitude of the received electrical signal. This signal is further processed onto the gain and emphasis schematic block 27 to further enhance effectiveness of the audio signal by causing the higher frequencies (which indicate more severe acceleration) to have a higher amplitude than the signal output of lower frequencies. Finally, audio output device schematic block 28, a set of headphones, receives the signal from the gain and emphasis schematic block 27. It is noted that the desired emphasis portion of schematic block 27 may be obtained in combination with the audio output device of schematic block 28 by taking advantage of the high-pass type response inherent in headphones commonly available.

Figure 6:
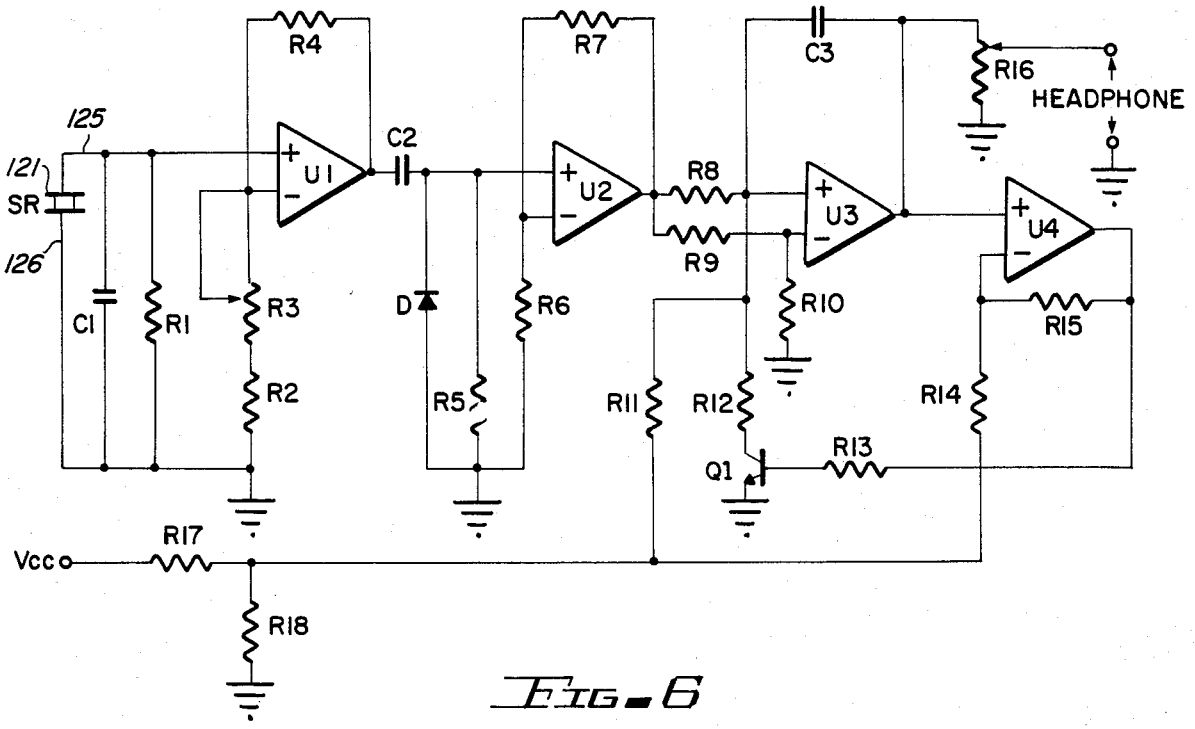
FIG. 6 is a block schematic diagram of an alternate embodiment of the invention.

Referring now to FIG. 6, electrical schematic of the alternate embodiment shown in FIG. 5 is detailed. The circuit shown embodies conventional engineering design applying known methods to accomplishing specific purposes. More specifically, commencing at the far left hand side of the electrical circuit, piezoceramic bender element 121 is detailed with its electrical output leads 125 and 126. This comprises the motion sensor.

The filter/gain block comprises capacitor C1, the piezoceramic bender element impedance itself SR, resistor R1, and the input impedance of amplifier U1, together with amplifier U1 and U2. The filter rejects the high frequency outputs from the piezoceramic bender element 121 and the amplifiers U1 and U2, connected in conventional manner, provide the gain. This voltage gain may be varied by potentiometer R3.

The electrical signal output of amplifier U2 is directed to the voltage to frequency processor implemented by integrator U3, comparator U4, and transistor Q1. This configuration produces a zero electrical signal output for zero electrical signal input. With no output from the sensor 121, no output is realized from amplifier U2, and current provided by resistor R11 from the battery potential Vcc forces the output integrator U3 to zero. In this state, comparator U4 output is high and transistor Q1 is turned on. With Q1 turned on, a positive voltage signal to integrator U3 results in the following output from integrator U3:

$$E(t) = \frac{1}{4R_9C_3} \int_0^{t_1} E_i dt$$

Where $E_i$ is the input to U3 and $t_1$ is the period of time over which the input is integrated. When the level given by the voltage expression above exceeds the voltage on the "+" terminal of comparator U4, the comparator will switch to a low output and turn transistor Q1 off. In this state, the input to integrator ($E_i$) results in an output of integrator U3 as follows:

$$E_1(t) = E_1 - \frac{1}{4R_9C_3} \int_{t_1}^{t_2} E_i dt$$

Note that $R_9 = R_{10} = R_{12}$ and $R_8 = 2R_9$.

When the output of integrator U3 drops below the new value $E_+$ on the "+" terminal of comparator U4, the comparator again switches transistor Q1 to the "on" state and the above process repeats.

As a result of the switched integrator sequence, a triangular wave with amplitude determined by the comparator hystersis (R14, R15) is generated. Frequency of this triangular wave is determined by the amplitude of the sensed acceleration from piezoceramic bender element 121. In the absence of sensed acceleration, there is no output from integrator U3. When acceleration is sensed, an output is derived whose frequency is proportional to the sensed acceleration.

In FIG. 6, the emphasis network previously described in connection with FIG. 5 is inherent in the headphones utilized.

The purpose of the emphasis network is to further enhance effectiveness of the audio output by causing the higher frequencies (indicating more severe acceleration) to have higher amplitudes than the output of lower frequencies. This is accomplished in FIG. 6 by taking advantage of the normal characteristics of the commonly available audio output device used, here the headphones. In that respect, the headphones shown in FIG. 6 represents the audio output device shown in block 28 and the emphasis portion of block 27 in FIG. 5. Potentiometer R16 functions as a volume control for the headphones.

It is to be noted that in the preferred embodiment, the sensor output is an electrical signal related to acceleration movement of the golf player's head and it is this signal which is processed onto the audio output device. Different types of elements can provide the signals necessary which indicate movement of the golf player's head. In some cases these devices may not indicate acceleration, but head movement velocity, or different positions of the head from one time to the next. Since acceleration is related to velocity and to position by mathematical integration, any of these indications may be processed. For example, the peizoceramic bender element could be replaced by currently available strain gauges, or capacitive type sensing.

For example, a piezo-electric (piezoceramic) strain gauge such as the type manufactured by Peizo Electric Products, Inc., may be cemented to a mechanical member, such as a cantilevered beam as may be represented by FIG. 3. When the cantilevered beam is mechanically deformed in response to acceleration, the piezo-electric strain gauge outputs a voltage which is received and processed as in the preferred embodiment.

In addition, conventional resistance type strain gauges may be applied to mechanical members in a similar manner as the piezo-electric strain gauge above. The conventional strain gauge resistance is set in the electrical network in a four resistance bridge circuit where changes in the strain gauge resistance due to deformation of the mechanical element is sensed and amplified through conventional techniques. This amplified signal then is processed in accordance as is with the preferred embodiment of the invention.

In addition, there are devices designed to sense acceleration such as charge sensitive accelerometers which output a signal proportional to acceleration sensed. All these are known in the art, and with conventional engineering skill may be adapted to be substituted for the acceleration sensing device of Applicant.

In addition, the processing unit which has been shown in the preferred embodiment converting the movement acceleration output to a voltage amplitude to frequency convertor, could just as well convert the acceleration output signal to an amplitude output as a function of acceleration, or as an amplitude and frequency both a function of acceleration. Techniques to process these signals in this manner are well known in the electronic circuit art.

Further, it is not necessary always to convert the output of single signal processing unit to an audio tone, as a visible light output could be utilized to inform the golf player of his movements or any other visual indication. Further, the golfer could be informed by the sense of feeling where perhaps the electrical signal would be connected directly to the skin of the golf player and he would feel a tingle as the electrical current passed into his body.

In the preferred embodiment, the piezoceramic bender element 121 together with its plate 123 shown in FIG. 3, and the signal processing unit above discussed with its electrical battery source would be located in the container 10 attached to the golf player's cap or in any other means held proximate the golfer's head. In the preferred embodiment, the container was located on the side of the golfer's head to sense movement in the horizontal and vertical direction. If for any reason, movement in any two directions of any limb wished to be sensed, the container 10 would only need be moved to an appropriate position on the participant's limb. If for example, the container were moved to the forehead area from the side of the head, it would sense movement in the vertical, and forward and back direction.

While a preferred embodiment of the subject invention together with suggested alternate embodiments has been shown and described, it will be appreciated that still other embodiments are readily apparent and that the subject invention is not to be limited except in accordance with the appended claims.

We claim:

1. A device for sensing and in real time indicating movement of a golf player's head comprising:

a motion sensor operably attached to the head of a golf player, said motion sensor continuously outputting an electrical signal proportional to the movement sensed;

a signal processing unit to receive signals from said motion sensor and to output a continuously processed signal; and an audio output device adapted to receive the output from said signal processing unit and give audio indication of the movement sensed whereby said audio output device indicates audibly to the golf player that his head is moving.

2. The device for sensing and indicating movement as defined in claim 1 wherein said motion sensor senses movement in at least two directions at a flat plane.

3. The device for sensing and indicating movement as defined in claim 2 wherein said motion sensor senses movement in the vertical and horizontal direction.

4. The device for sensing and indicating movement as defined in claim 3 wherein said signal processing unit defines means to convert the received electrical signal to an electrical oscillator output.

5. The device for sensing and indicating movement as defined in claim 4 wherein said audio output device comprises headphones adapted to be worn by the golf player.

6. The device for sensing and indicating movement as defined in claim 5 wherein said signal processing unit includes a voltage to frequency processor.

7. The device for sensing and indicating movement as defined in claim 6 wherein said signal processing unit additionally includes a filter and amplifier receiving said motion sensor output signal, said filter and amplifier providing a filtered and amplified signal to said voltage to frequency processor, and an amplifier and frequency emphasis network receiving the signal from said voltage to frequency processor, said amplifier and frequency emphasis network supplying a signal to said audio output device.

8. The device for sensing and indicating movement as defined in claim 7 wherein said motion sensor defines a peizoceramic bender element mounted in a cantilevered construction to a reference surface, said reference surface operably attached to the golf player's head.

9. The device for sensing and indicating movement as defined in claim 8 wherein said piezoceramic bender element is oriented in a vertical plane bisecting the golf player's arms, shoulders, torso, and head.

* * * * *